United States Patent [19]

Carré

[11] 4,217,022

[45] Aug. 12, 1980

[54] CONNECTOR WITH OPTICAL INSPECTIONS MEANS FOR RIBBON CABLE

[75] Inventor: Jacques Carré, Suresnes, France

[73] Assignee: Socapex, France

[21] Appl. No.: 972,901

[22] Filed: Dec. 26, 1978

[30] Foreign Application Priority Data

Dec. 30, 1977 [FR] France ..... 77 39772

[51] Int. Cl.[2] ..... H01R 9/04

[52] U.S. Cl. ..... 339/99 R

[58] Field of Search ..... 339/99 R, 98, 176 MF, 339/275 T, 276 T; 350/96.20, 96.21; 29/407

[56] References Cited

U.S. PATENT DOCUMENTS

| | | | |
|---|---|---|---|
| 2,503,677 | 4/1950 | McHenry et al. | 339/113 R |
| 3,286,223 | 11/1966 | Narozny | 339/276 T |
| 3,665,367 | 5/1972 | Keller | 339/275 T |
| 3,793,611 | 2/1974 | Johansson | 339/98 |

*Primary Examiner*—Joseph H. McGlynn
*Assistant Examiner*—John S. Brown
*Attorney, Agent, or Firm*—Cushman, Darby & Cushman

[57] ABSTRACT

Connector with insulation piercing lugs for ribbon cable, in which the connection of each wire of the cable, is achieved by insertion in a slot having cutting edges (13) located on a lug (6) of the connector (1) through the action of a pusher member (14). The pusher member (14) comprises in its upper portion a plurality of magnifying lenses constituted by a single block (41) therewith and enabling accurate visual inspection of each wire insertion process, without any need for disassembly.

10 Claims, 7 Drawing Figures

CONNECTOR WITH OPTICAL INSPECTIONS MEANS FOR RIBBON CABLE

The present invention relates to the field of connectors for electrical conducting cables with a plurality of mutually insulated wires, in cases where these wires are placed side by side in a flat ribbon arrangement wherein the wires are held together by their insulating covering, this arrangement being formed herein after, for simplifying, as a "ribbon cable".

Plug-in connection of ribbon cables is achieved by the use of connectors in two parts, each part comprising, in an insulating block, a plurality of conductive contact elements. Each wire, which has been previously stripped over a suitable length, by removal of its insulating sheath, is connected to one of the contact elements, one extremity of which is adapted for this connection, which is most often effected by soldering; the other extremity of each contact element, either in the form of a male pin or of a female socket, provides plug-in connection with the contact elements of a complementary shape borne by the other part of the connector.

However, the large number of wires contained in a ribbon cable, which may be 50 in typical cases, makes the series of soldering operations a long and costly process, and it has been proposed to apply the advantages of wire-to-contact connection by means of insulation piercing lugs to this field. A typical embodiment of such a lug consists in a plate located at the extremity of the contact, a slot that is open at one extremity being provided in said plate. If a conductor wire of a suitable diameter is inserted by its lateral surface in this slot, the lateral edges of said slot partially penetrate the wire, establishing electric contact and mechanically attaching the wire to the lug. If the wire is covered by a sheath of insulating material, said sheath is cut into under the same conditions by the edges of the slot; in this way electric contact is established, with insulation piercing.

Finally, in the case of ribbon cables, where each sheathed wire of the ribbon is connected by its lateral surface to the adjacent wires by means of two intermediate walls, often of the same material as the sheath, the piercing lug has, at the open extremity of its slot, a pair of points for piercing the two walls, thus giving the insulation piercing lug the general shape of a fork.

Connection between each wire and each lug of a connector designed for ribbon cables is thus very rapid, particularly if all the wires of a cable are penetrated simultaneously using a common thrust member.

However, as a function of any variations in the relative positions of each conductive wire in the insulating ribbon, and of each contact in the insulating block of each connector, it has been noted that, when the ribbon cable penetrates the lug assembly, certain wires do not penetrate the corresponding forks, but deviate outside said forks. This anomaly cannot be detected by electrical checking as contact is established but, after ageing, chemical deterioration occurs and random defects appear progressively. No destructive testing is possible and the connectors have to be dismantled in order to locate these faulty contacts; if, in addition, several connectors are fixed simultaneously to the same cable, it is difficult , if not impossible, to locate the defective lug rapidly. This type of defect can affect up to 5% of the connections and, in the case of ribbon cables, reduces the practical value of connection by means of insulation pierce type lugs.

The insulation pierce type connector according to the present invention for ribbon cables does not have these drawbacks.

It makes it possible to inspect immediately and simultaneously the plurality of connections between the wires of the ribbon cable and the forks of the automatic baring lugs without any need for disassembly or application of electric energy, simply by the use of optical means: this means is non-destructive, efficient and of low cost. It consists of a plurality of convergent optical dioptres disposed opposite the zone of the ribbon cable where penetration, piercing and electric connection by the forks take place, performing the functions of a plurality of magnifying lenses providing visual magnification of this zone; according to the invention, this inspection means is associated, in the connector, with the means ensuring application of the force for simultaneous penetration of the wires of the ribbon cable in the lugs, namely the pusher member forming part of the connector. The invention thus provides for one and the same means to perform two functions in a novel manner, a mechanical function and an optical function. For this purpose, the material by which the pusher member is constituted is selected from among those that are suitable, by virtue of their physical properties of transparency and refractive index, to form part of optical devices; in addition, the shape of the pusher surfaces disposed opposite zones of ribbon cable to be inspected is chosen so as to constitute pluralities of convergent dioptres of suitable optical power for proper observation, with a sufficient degree ° of magnification.

An optical inspection connector is thus proposed, according to the invention, for ribbon cable, cable in strip form constituted by a plurality of adjacent conductor wires held together by a plane common insulating envelope, comprising, in the first place, a block of insulating material provided with a housing to receive the cable and, in the second place, a given number of contact elements with lugs of the insulation pierce type, said lugs projecting into said housing, and, in the third place, a mobile pusher member ensuring that a force is applied to the cable to insert the wires into the lugs; the pusher is provided with optical elements of the "convergent dioptre" type, disposed opposite the insulation piercing lugs, with their optical axes directed parallel to the direction of said force of insertion.

The invention will be more readily understood with the help of the following description and with reference to the attached figures, wherein.

Figure 5:
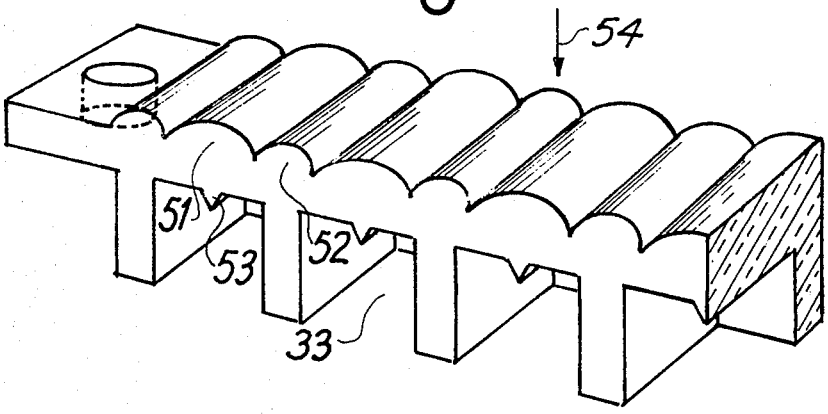
FIG. 5 illustrates an advantageous alternative form of embodiment of the invention.
Figure 6:
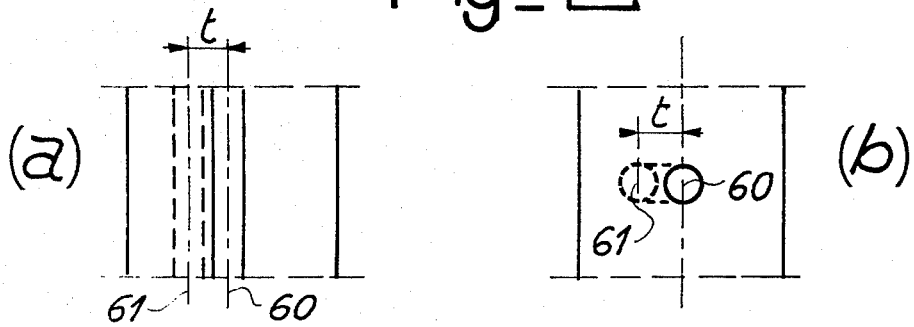

FIG. 6(*a*) and 6(*b*) are explanatory diagrams of the way in which the connector of FIG. 5 functions.

Figure 1:
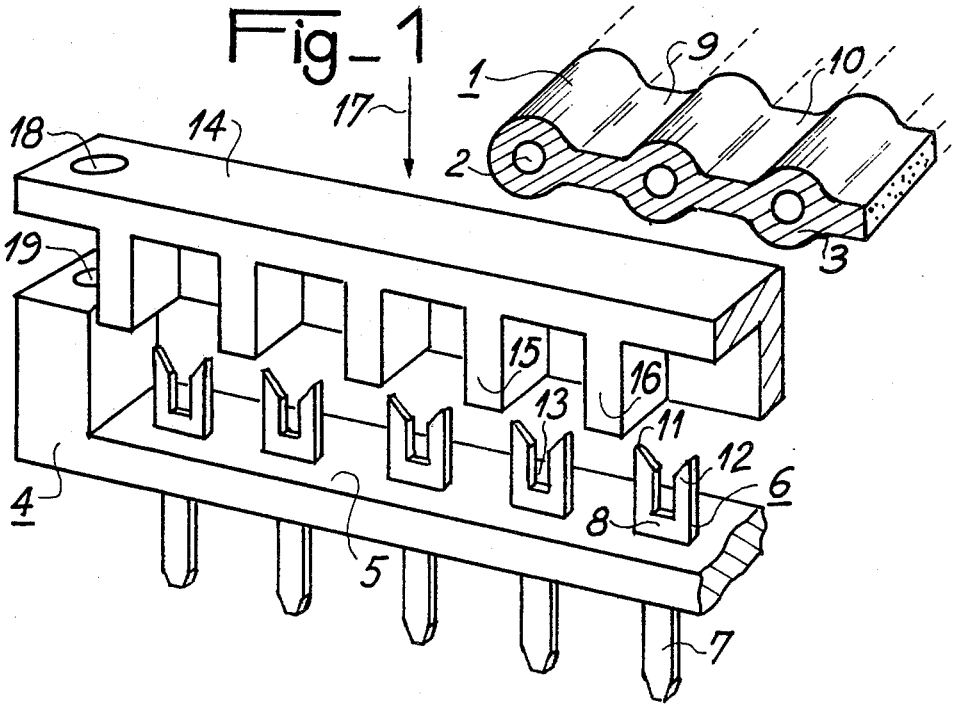
FIG. 1 represents a perspective view in partial cross-section of a connector for a ribbon cable, with insulation piercing lugs of the known type.

FIG. 1 represents a perspective view with a partial cross-section of one of the two parts of an insulation piercing connector for ribbon cables, according to prior art.

Such a cable, which is illustrated in the figure in partial cross-section, has the general shape of a strip 1, wherein a plurality of conductor wires such as 2 placed side by side and joined together by a flexible insulating material 3.

The connector comprises an insulating block 4, provided with a transverse housing 5 to receive the cable, said block supporting a plurality of contact elements 6. Each element includes, on one hand, an external portion 7, to provide for connection with a contact element of a complementary shape borne by another part of a connector, not represented, and, on the other hand, an internal portion 8, providing for electrical connection with one of the wires of the ribbon cable by means of insulation piercing.

This known feature consists in the intermediary wall of the cable being pierced at 9 and 10 by two points 11 and 12 of the lug, in that the sheath 3 of the wire is cut by the edges of slot 13 and, finally, in the establishment of electrical contact by these edges with the conductive core of the wire. These cutting edges of the slot only make a narrow cut in the insulating sheath which, by elasticity, closes back over the two zones of contact and protects them from damage by the environment (humidity, various forms of chemical attack).

The ribbon cable is inserted into the lugs by the action of a pusher member 14 projecting parts 15 and 16 apply thrust in the direction of arrow 17 to the intermediate connecting walls 9 and 10.

The connection is made complete by rendering the pusher member and the support block integral by means of screws inserted into the openings 18 and 19. After being closed, the connector has the general shape of a closed box and, owing to the nature of the insulating materials habitually used, visual inspection of the insertion of the wires into the lugs is impossible.

Figure 2:
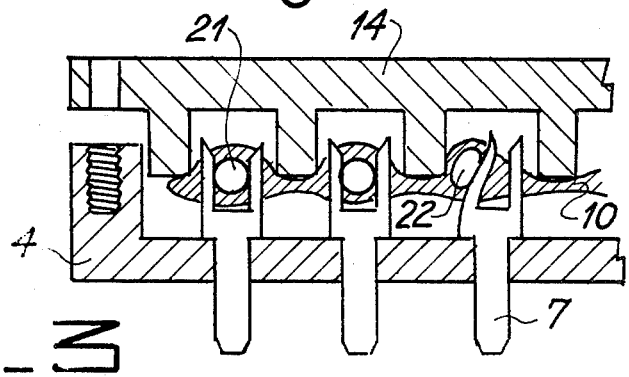
FIG. 2 is an explanatory cross-section illustrating a drawback of the use of such a connector.

FIG. 2 is an explanatory cross-section to illustrate a drawback of the use of such a connector.

There is, in fact, mechanical "play" between the components parts of the connector, for example between the support block and the pusher member, or between the contacts and the support block, or again, between projections 16 and lugs 8. Furthermore, the geometrical accuracy of the dimensions of the ribbon cable is only small owing to the fact that the material is flexible, particularly as regards the centre to centre distance between two adjacent wires.

As a result, when used, while certain wires, such as 21 are inserted correctly into the slots in the lugs, others, such as 22, escape from these slots and become placed outside them. The proportion of this anomaly can, in practice, exceed 5% of the wires in question and is all the more prejudicial in that it cannot be detected by electrical verification since there is nonetheless contact.

However, the cut in the insulating sheath, which is wide, as it has been made by an external portion of the lug, does not protect the contact zone from the environment and contact becomes intermittent and even ceases completely after a certain time.

Figure 3:
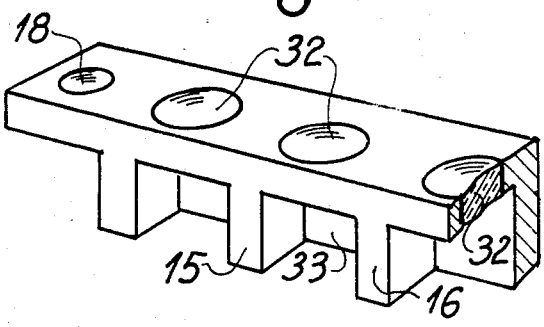
FIGS. 3 and 4 represent two forms of embodiment of a connector according to the invention.

FIG. 3 illustrates a pusher member of a connector with a plurality of optical elements 32 of the convergent dioptre type, often designated by the term "magnifying glass". Each magnifying glass is disposed opposite one of the housings 33 designed to receive an automatic baring lug, and, owing to its magnification of the zone that can thus be viewed, it is possible to verify easily and accurately whether or not the wire has been inserted correctly in the slot of the lug.

It should be noted that it would not be possible to make such an inspection to any purpose simply by making an opening in the pusher member without using a magnifying optical element, owing to the very small dimensions of the elements in question; according to a typical value, given by way of example, the distance between two adjacent wires in a standardised ribbon cable of the known type is 1.27 mm, which implies, practically speaking, the possibility of examining positions of ±100 micrometers. The use of magnifying optical elements is thus an essential feature of the present invention.

Figure 4:
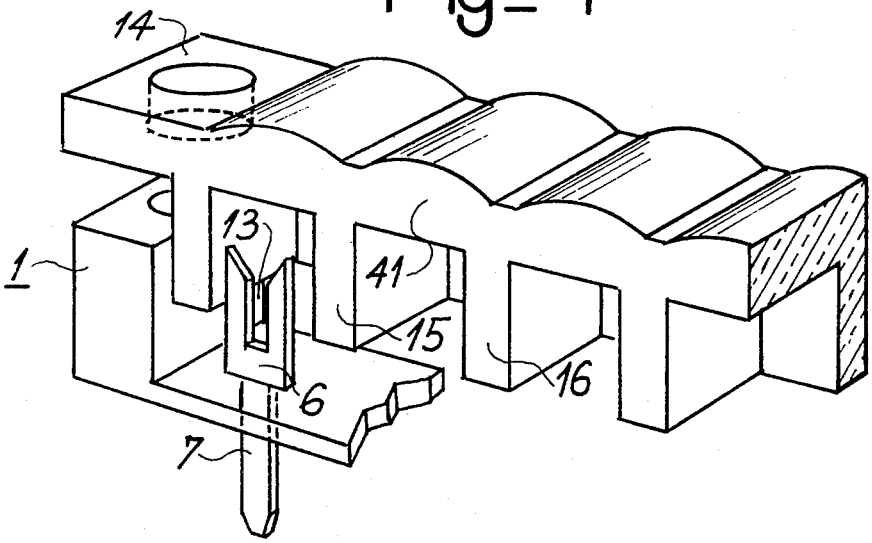

FIG. 4 illustrates a particularly advantageous form of embodiment of the invention. According to this form, the pusher member 14 is made entirely of optically transparent material and bears directly, in one and the same continuous piece of material, convergent optical dioptres 41, which are here of the cylindrical type; it thus performs two functions simultaneously, that of transmitting an insertion force and that of optical magnification. The material can be selected from a wide range of chemical compounds which generally possess when they are transparent, the simultaneous properties of electrical insulators; methyl polymetacrystal can be mentioned, for example, as being well suited to the constitution of a pusher member according to the invention, as it is also easy to form by moulding or machining.

FIG. 5 illustrates a variant of the form of embodiment in the preceding figure, wherein the more numerous convergent optical dioptres, 51 and 52, make it possible to examine simultaneously the lateral branches of each lug and the axis of each wire.

In addition, a projection 53, provided in each housing of the pusher member, ensures that an impression is made in the insulating sheath of each wire throughout the time of insertion.

FIG. 6, formed of two parts, (a) and (b), shows two diagrams that explain the functions of the axial projection 53 of the preceding figure.

In (a), the projection is constituted by a line having a triangular cross-section and, in (b), it is constituted by a cone.

When a wire is inserted into the corresponding lug, the axial projection penetrates the insulating envelope, where it makes an impression 60. If insertion has taken place correctly, the axial projection moves parallel to the direction of insertion 54 and the impression remains concealed by the projection at the time of observation; if, on the other hand, insertion is incorrect, the wire and its insulating sheath move laterally, in relation to the direction of insertion, and the impression moves progressively in the same direction. At the end of insertion, the impression then occupies position 61, corresponding to a total width of t.

This wider total impression is clearly visible upon observation and immediately indicates defective insertions. The association of optical inspection means and means for indicative marking, in conjunction with the insertion pusher member, thus provides number of results that are particularly advantageous in practical applications, particularly on construction sites.

I claim:

1. Connector with optical inspection means for ribbon cable, cable in strip form constituted by a plurality of adjacent conductor wires joined together by a plane common insulating envelope including firstly a block of insulating material provided with a housing for receiving the cable, secondly, a given number of contact elements with insulation pierce type lugs, said lugs projecting into said housing and thirdly, a mobile pusher member ensuring that a force is applied to the cable for inserting the wires into the lugs, wherein the pusher member is provided with optical elements of the "convergent dioptre" type, disposed opposite insulation pierce type lugs, with their optical axes orientated parallel to the direction of said force of insertion.

2. Connector according to claim 1, wherein the convergent dioptres are constituted by spherical lenses.

3. Connector according to claim 1, wherein the convergent dioptres are constituted by cylindrical lenses.

4. Connector according to one of the preceding claims, wherein the convergent dioptres are fixed in openings made in the pusher member.

5. Connector according to one of claims 1 to 3, wherein the pusher member is constituted by a transparent material, the convergent dioptres being made of the same material in one and the same single continuous block.

6. Connector according to claim 5, wherein the pusher member is produced by machining.

7. Connector according to claim 5, wherein the pusher member is produced by moulding.

8. Connector according to claim 1, wherein the pusher member comprises a plurality of axial projections opposite insulation piercing lugs.

9. Connector according to claim 8, wherein the projections are shaped like straight beadings with a triangular cross-section.

10. Connector according to claim 8, wherein the projections are cone-shaped.

* * * * *